US007533722B2

(12) United States Patent
George et al.

(10) Patent No.: US 7,533,722 B2
(45) **Date of Patent: *May 19, 2009**

(54) SURGE CHAMBER ASSEMBLY AND METHOD FOR PERFORATING IN DYNAMIC UNDERBALANCED CONDITIONS

(75) Inventors: Flint R. George, Flower Mound, TX (US); Ryan A. Harrison, Carrollton, TX (US); Roger C. Watson, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

This patent is subject to a terminal disclaimer.

(21) Appl. No.: 11/818,408

(22) Filed: Jun. 14, 2007

(65) Prior Publication Data

US 2007/0240873 A1 Oct. 18, 2007

Related U.S. Application Data

(63) Continuation of application No. 10/841,817, filed on May 8, 2004, now Pat. No. 7,243,725.

(51) Int. Cl.
*E21B 43/116* (2006.01)

(52) U.S. Cl. ..... 166/299; 166/55.2; 166/63; 166/256; 166/297

(58) Field of Classification Search ..... None
See application file for complete search history.

(56) References Cited

U.S. PATENT DOCUMENTS 3,186,485 A * 6/1965 Owen ..... 166/63
3,948,321 A * 4/1976 Owen et al. ..... 166/277
4,175,042 A 11/1979 Mondshine
4,484,632 A 11/1984 Vann
4,557,331 A 12/1985 Stout (Continued)

FOREIGN PATENT DOCUMENTS

EP 0 155 128 B1 8/1988

(Continued)

OTHER PUBLICATIONS

Slentz; "Geochemistry of Reservoir Fluids as a Unique Approach to Optimum Reservoir Management"; Middle East Oil Technical Conference of the Society of Petroleum Engineers; SPE 9582; Mar. 9-12, 1981; 14 pages.

(Continued)

*Primary Examiner*—Zakiya W. Bates
(74) *Attorney, Agent, or Firm*—Lawrence R. Youst

(57) ABSTRACT

A surge chamber assembly (70) for use in a wellbore includes a housing (80) having one or more openings (112), a surge chamber (100) and a combustion chamber (98). The openings (112) provide fluid communication between the exterior (82) of the housing (80) and the surge chamber (100). A sleeve (114) is slidably positioned within the housing (80) and has a first position wherein fluid communication through the openings (112) is prevented and a second position wherein fluid communication through the openings (112) is allowed. A combustible element (124) is positioned in the combustion chamber (98) such that combusting the combustible element (124) generates pressure in the combustion chamber (98) that actuates the sleeve (114) from the first position to the second position.

17 Claims, 4 Drawing Sheets

U.S. PATENT DOCUMENTS

| | | | | |
|---|---|---|---|---|
| 4,605,074 | A | 8/1986 | Barfield | |
| 4,616,701 | A | 10/1986 | Stout et al. | |
| 4,650,010 | A | 3/1987 | George et al. | |
| 4,862,964 | A | 9/1989 | George et al. | |
| 5,058,674 | A | 10/1991 | Schultz et al. | |
| 5,088,557 | A | 2/1992 | Ricles et al. | |
| 5,103,912 | A | 4/1992 | Flint | |
| 5,287,741 | A | 2/1994 | Schultz et al. | |
| 5,551,344 | A | 9/1996 | Couet et al. | |
| 5,635,636 | A | 6/1997 | Alexander | |
| 5,865,254 | A | 2/1999 | Huber et al. | |
| 6,173,783 | B1 | 1/2001 | Abbott-Brown et al. | |
| 6,325,146 | B1 | 12/2001 | Ringgenberg et al. | |
| 6,347,673 | B1 | 2/2002 | Dailey | |
| 6,394,184 | B2 | 5/2002 | Tolman et al. | |
| 6,446,719 | B2 | 9/2002 | Ringgenberg et al. | |
| 6,446,720 | B1 | 9/2002 | Ringgenberg et al. | |
| 6,527,052 | B2 | 3/2003 | Ringgenberg et al. | |
| 6,554,081 | B1 | 4/2003 | Brooks et al. | |
| 6,598,682 | B2 * | 7/2003 | Johnson et al. | 166/370 |
| 6,732,798 | B2 | 5/2004 | Johnson et al. | |
| 6,874,579 | B2 | 4/2005 | Johnson et al. | |
| 6,896,059 | B2 | 5/2005 | Brooks et al. | |
| 6,966,377 | B2 | 11/2005 | Johnson et al. | |
| 7,036,594 | B2 | 5/2006 | Walton et al. | |
| 7,182,138 | B2 | 2/2007 | Behrmann et al. | |
| 7,243,725 | B2 | 7/2007 | George et al. | |
| 7,284,612 | B2 | 10/2007 | Ratanasirigulchai et al. | |
| 7,287,589 | B2 | 10/2007 | Grove et al. | |
| 7,428,921 | B2 | 9/2008 | Grove et al. | |

FOREIGN PATENT DOCUMENTS

| | | |
|---|---|---|
| EP | 0 415 770 B1 | 3/1996 |
| GB | 2 396 175 A | 6/2004 |
| GB | 2 406 114 | 3/2005 |
| GB | 2 406 865 | 4/2005 |
| WO | WO 99/42696 | 8/1999 |
| WO | WO 01/25595 A1 | 4/2001 |
| WO | WO 01/65060 | 9/2001 |

OTHER PUBLICATIONS

Ruhovets et al.; "Volumes, Types, and Distribution of Clay Minerals in Reservoir Rocks Based in Well Logs"; SPE/DOE Unconventional Gas Recovery Symposium of the Society of Petroleum Engineers; SPE/DOE 10796; May 16-18, 1982; 14 pages.

Bartuslak et al.; "Experiments Investigate Underbalance Flow Velocity and Volume Needed to Obtain Perforation Cleanup"; Eastern Regional Conference and Exhibition; SPE 26896; Nov. 3-4, 1983; pp. 1-10.

Regalguto et al.; "Underbalanced Perforation Characteristics as Affected by Differential Pressure"; 18th Annual OTC; OTC 5245; May 5-8, 1986; 8 pages.

King et al.; "A Field Study of Underbalance Pressures Necessary to Obtain Clean Perforations Using Tubing-Conveyed Perforating"; Journal of Petroleum Technology; SPE 14321; Jun. 1986; pp. 662-664.

Regalbuto et al.; "Underbalanced Perforation Characteristics as Affected by Differential Pressure"; SPE Production Engineering; SPE 15816; Feb. 1988; pp. 83-88.

Colle; "Increase Production with Underbalanced Perforation"; Petroleum Engineer International; Jul. 1988; pp. 39-42.

Behrmann et al.; "Effect of Concrete and Berea Strengths on Perforator Performance and Resulting Impact on the New API RP-43"; 63rd Annual Technical Conference and Exhibition of the Society of Petroleum Engineers; SPE 18242; Oct. 2-5, 1988; pp. 1-15.

Behrmann et al.; "Effects of Wellbore Pressure on Perforator Performance Depth"; 63rd Annual Technical Conference and Exhibition of the Society of Petroleum Engineers; SPE 18243; Oct. 2-5, 1988; pp. 1-7.

Halleck et al.; "Reduction of Jet Perforator Penetration in Rock Under Stress,"; 63rd Annual Technical Conference and Exhibition of the Society of Petroleum Engineers; SPE 18245; Oct. 2-5, 1988, pp. 627-641.

Halleck et al.; "Effects of Underbalance on Perforation Flow"; SPE Production Engineering; May 1989; pp. 113-116.

Deo et al.; "Linear and Radial Flow Targets for Characterizing Downhole Flow in Perforations"; SPE Producing Engineering; Aug. 1989; pp. 295-300.

Crawford; "Underbalanced Perforating Design", 64th Annual Technical Conference and Exhibition of the Society of Petroleum Engineers; SPE 19749; Oct. 8-11, 1989; pp. 431-444.

Pearce et al.; "Clean Out Existing Well Perforations by Surging the Formation"; World Oil; Dec. 1989; 5 pages.

Tariq; "New Generalized Criteria for Determining the Level of Underbalanced for Obtaining Clean Perforations"; 65th Annual Technical Conference and Exhibition of the Society of Petroleum.

Andersen et al.; "Exploiting Reservoirs with Horizontal Wells: The Maersk Experience"; Offshore; Feb. 1991; pp. 23-32.

Schultz et al.; "Small-Volume Sampling Technique Brings Economy and Efficiency to Well Testing Operations"; Production Operations Symposium; SPE 21706; Apr. 7-9, 1991; pp. 693-700.

Petak et al.; "Surge Test Simulation"; Rocky Mountain Regional Meeting and Low-Permeability Reservoirs Symposium; SPE 21832; Apr. 15-17, 1991; pp. 259-274.

Petak et al.; "Drillstem Test and Closed-Chamber Drillstem Test Simulation"; Offshore Europe Conference; SPE 23115, Sep. 3-6, 1991; pp. 143-160.

Halleck et al.; "Prediction of In-Situ Shaped-Charge Penetration using Acoustic and Density Logs", 66th Annual Technical Conference and Exhibition of the Society of Petroleum Engineers; SPE 22808; Oct. 6-9, 1991; pp. 483-490.

Behrmann et al.; "Measurement of Additional Skin Resulting From Perforation Damage"; 66th Annual Technical Conference and Exhibition of the Society of Petroleum Engineers; SPE 22809; Oct. 6-9, 1991; pp. 491-502.

Hsia et al.; "Perforating Skin as a Function of Rock Permeability and Underbalance"; 66th Annual Technical Conference and Exhibition of the Society of Pertroleum Engineers; SPE 22810, Oct. 6-9, 1991 pp. 503-510.

Pucknell et al.: "An Investigation of the Damaged Zone Created by Performing"; 66th Annual Technical Conference and Exhibition of the Society of Petroleum Engineers; SPE 22811; Oct. 6-9, 1991; pp. 511-522.

Behrmann et al.: "Effects of Underbalance and Effective Stress on Perforation Damage in Weak Sandstone: Initial Results"; 67th Annual Technical Conference and Exhibition of the Society of Petroleum Engineers; SPE 24770; Oct. 4-7, 1992; pp. 81-90.

Halleck et al.: "X-Ray CT Observations of Flow Distribution in a Shaped-Charge Perforation"; 67th Annual Technical Conference and Exhibition of the Society of Petroleum Engineers; SPE 24771; Oct. 4-7, 1992; pp. 91-100.

Tronvoll et al.; "Observations of Sand Production and Perforation Cleanup in a Weak Sandstone", SPE/ISRM Rock Mechanics in Petroleum Engineering Conference; SPE 28071; Aug. 29-31, 1994; pp. 355-360.

Halleck et al.; "Estimating Perforation Flow From Variation in Indentation Hardness"; Society of Petroleum Engineers; SPE 24769; 1995; pp. 1-8.

Blosser; "An Assessment of Perforating Performance for High Compressive Strength Non-Homogeneous Sandstones"; European Formation Damage Conference; SPE 30082; May 15-16, 1995; pp. 31-35.

Rezmer-Cooper et al.; "Complex Well Control Events Accurately Represented by an Advanced Kick Simulator"; SPE European Petroleum Conference; SPE 36829; Oct. 22-24, 1995; pp. 141-156.

Scott et al.; "Air Foam Improves Efficiency of Completion and Workover Operations in Low-Pressure Gas Wells"; SPE Drilling & Completion; Dec. 1995; pp. 219-225.

PetitJean et al.; "Modeling of Fracture Propagation During Overbalanced Perforation"; Society of Petroleum Engineers; SPE 28560; 1996; 12 pages.

Couet et al.; "Well-Productivity Improvement by Use of Rapid Overpressured Perforation Extension: Case History"; JPT; Feb. 1996; pp. 154-159.
Bartusiak et al.; "Experimental Investigation of Surge Flow Velocity and Volume Needed to Obtain Perforation Cleanup"; Journal of Petroleum Science and Engineering; Apr. 8, 1996; pp. 19-28.
Behrmann; "Underbalance Criteria for Minimum Perforation Damage"; SPE Drilling & Completion; Sep. 1996; pp. 173-177.
Halleck et al.; "Experiments and Computer Analysis Show How Perforators Damage Natural Fractures"; SPE Eastern Regional Meeting, SPE 37330; Oct. 23-25, 1996; pp. 1-11.
Halleck; "Recent Advances in Understanding Perforator Penetration and Flow Performance"; SPE Drilling & Completion; Mar. 1997; pp. 19-26.
Halleck; et al; "The Basis and use of the API RP43 Flow Test for Shaped-Charge Oil Well Perforators"; JCPT, vol. 36, No. 5; May 1997; pp. 53-61.
Behrmann et al.; "Borehole Dynamics During Underbalanced Perforating"; SPE European Formation Damage Conference; SPE 38139 Jun. 2-3, 1997; pp. 17-24.
Swift et al.; "Micro-Mechanical Modeling of Perforating Shock Damage"; SPE Formation Damage Conference; SPE 39458; Feb. 18-19, 1998; pp. 381-391.
Marple et al.; "Successful Completions in the Gulf of Mexico Using the Single-Trip Performation and Packing System", Offshore Technology Conference; OTC 8583; May 4-7, 1998; pp. 83-93.
Halleck et al.; "Mechanical Damage Caused by Perforations May Affect Fracture Breakdown", SPE Eastern Regional Meeting: SPE 51051; Nov. 9-11, 1998; pp. 131-137.
Thiercelin et al.; "Cement Design Based on Cement Mechanical Response", SPE Drilling & Completion; Dec. 1998; pp. 266-273.
Dyson et al.; "Best Completion Practices", SPE/IADC Drilling Conference; SPE/IADC 52810; Mar. 9-11, 1999; pp. 187-196.
Behrmann et al.; "Underbalance or Extreme Overbalance"; SPE Prod. & Facilities, vol. 14, No. 3, Aug. 1999; pp. 1-7.
"Comparison of Balanced and Unbalanced Perforating"; JPT; Oct. 1999; pp. 64-66.
Schatz et al.; "High-Speed Downhole Memory Recorder and Software Used to Design and Confirm Perforating/Propellant Behavior and Formation Fracturing"; SPE Annual Technical Conference and Exhibition; SPE 56434; Oct. 3-6, 1999; pp. 1-9.
Dogulu et al.; "Numerical Simulation of Perforation Cleanup with Transient Surge Flow"; Proceedings of ETCE/OMAE2000 Joint Conference; Feb. 14-17, 2000; pp. 1-9.
Arora et al.; "The Nature of the Compacted Zone Around Perforation Tunnels"; SPE International Symposium on formation Damage Control; SPE 58720; feb. 23-24, 2000; pp. 1-12.
Venkitaraman et al.; "Perforating Requirements for Sand Prevention"; SPE International Symposium on Formation Damage Control; SPE 58788; Feb. 23-24, 2000; pp. 1-5.
Walton; "Optimum Underbalance for the Removal of Perforation damgae"; SPE Annual Technical Conference and Exhibition; SPE 63108; Oct. 1-4, 2000; pp. 1-13.
Venkitaraman et al.; "Perforating Requirements for Sand Control"; SPE European Petroleum Conference; SPE 65187; Oct. 24-25, 2000; pp. 1-8.
Karacan; "Effect of Pore Fluid Type on Perforation Damage and Flow Characteristics", SPE Production and Operations Symposium, SPE 67290; Mar. 24-27, 2001; PP. 1-11.
Walton et al.; "Perforating Unconsolidated Sands: An Experimental and Theoretical Investigation"; SPE Annual Technical Conference and Exhibition; SPE 71458; Sep. 30-Oct. 3, 2001; pp. 1-14.
Walton et al.; "Laboratory Experiments Provide New Insights into Underbalanced Perforating"; SPE Annual Technical Conference and Exhibition; SPE 71642; Sep. 30-Oct. 3, 2001; pp. 1-8.
Walton et al.; "Perforating Unconsolidated Sands: An Experimental and Theoretical Investigation"; SPE Drilling & Completion; Sep. 2002; pp. 141-150.
Behrmann et al.; "New Underbalanced Perforating Technique Increases Completion Efficiency and Eliminates Costly Acid Stimulation"; SPE Annual Technical Conference and Exhibition; SPE 77364; Sep. 29-Oct. 2, 2002; pp. 1-15.
Karacan et al.; "Correlating Particle Size Distribution in a Crushed Zone to Perforating Permeability Damage and Modeling Using Fragmentation Fractal Theory"; SPE Annual Technical Conference and Exhibition; SPE 77365; Sep. 29-Oct. 2, 2002; pp. 1-11.
Waskoenig et al.; "A Method for Real-Time Well Clean-Up Optimization", SPE Annual Technical Conference and Exhibition; SPE 77409; Sep. 29-Oct. 2, 2002; pp. 1-7.
Detwiler et al.; "Evaluation of the Relative Importance of Parameters Influencing Perforation Cleanup"; SPE International Symposium and Exhibition on Formation Damage Control; SPE 86538; Fe. 18-20, 2004; pp. 1-7.
Halleck et al.; "Changes in Perforation-Induced Formation Damage with Degree of Underbalance: Comparison of Sandstone and Limestone Formations"; SPE International Symposium and Exhibition; SPE 86541; Feb. 18-20, 2004; pp. 1-7.
Schatz et al.; High-Speed Pressure and Accelerometer Measurements Characterize Dynamic Dehavior During Perforating Events in Deepwater Gulf of Mexico*; SPE Annual Techical Conference and Exhibition; SPE 90042; Sep. 26-29, 2009; pp. 1-15.
"Optimum Completion Design"; Vann Systems; 19 pages (undated but admitted Prior Art).
"Optimum Completion Design"; TCP Virtual Field Guide; 263 pages (undated but admitted Prior Art).
Stutz, et al.; "Dynamic Under Balanced Perforating Eliminates Near Wellbore Acid Stimulation in Low-Pressure Weber Formation"; SPE International Symposium and Exhibition on Formation Damage Control; SPE 86543; Feb. 18-20, 2004; pp. 1-7.
EPO Search Report (Dated: May 24, 2005); 1 page.

* cited by examiner

SURGE CHAMBER ASSEMBLY AND METHOD FOR PERFORATING IN DYNAMIC UNDERBALANCED CONDITIONS

CROSS-REFERENCE TO RELATED PATENT APPLICATIONS

This is a continuation application of application Ser. No. 10/841,817 now U.S. Pat. No. 7,243,725, filed on May 8, 2004.

TECHNICAL FIELD OF THE INVENTION

This invention relates, in general, to perforating a cased wellbore that traverses a subterranean hydrocarbon bearing formation and, in particular, to a surge chamber assembly that is installed within the tool string and is operated to create a dynamic underbalanced pressure condition in the wellbore during such perforating.

BACKGROUND OF THE INVENTION

Without limiting the scope of the present invention, its background will be described with reference to perforating a subterranean formation using shaped charge perforating guns, as an example.

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more charge carriers or perforating guns are loaded with shaped charges that are connected with a detonator via a detonating cord. The charge carriers are then connected within a tool string that is lowered into the cased wellbore at the end of a tubing string, wireline, slick line, coil tubing or other conveyance. Once the charge carriers are properly positioned in the wellbore such that the shaped charges are adjacent to the formation to be perforated, the shaped charges may be fired. If more than one downhole zone is to be perforated, a select fire perforating gun assembly may be used such that once the first zone is perforated, subsequent zones may be perforated by repositioning and firing the previously unfired shaped charges without tripping out of the well.

The perforating operation may be conducted in an overbalanced pressure condition, wherein the pressure in the wellbore is greater than the pressure in the formation or in an underbalanced pressure condition, wherein the pressure in the wellbore is less than the pressure in the formation. When perforating occurs in an underbalanced pressure condition, formation fluids flow into the wellbore immediately after the casing is perforated. This inflow is beneficial as perforating generates debris from the perforating guns, the casing and the cement that may otherwise remain in the perforation tunnels and impair the productivity of the formation. As clean perforations are essential to a good perforating job, perforating underbalanced condition is preferred. It has been found, however, that due to safety concerns, maintaining an overbalanced pressure condition during most well completion operations is preferred. For example, if the perforating guns were to malfunction and prematurely initiate creating communication paths to a formation, the overbalanced pressure condition will help to prevent any uncontrolled fluid flow to the surface.

A need has therefore arisen for an apparatus and method for perforating a cased wellbore that create effective perforation tunnels. A need has also arisen for such and apparatus and method that provide for safe installation and operation procedures. Further, a need has arisen for such an apparatus and method that provide for the reuse of certain of the perforating string components.

SUMMARY OF THE INVENTION

The present invention disclosed herein comprises an apparatus and method for perforating a cased wellbore that create effective perforation tunnels. The apparatus and method of the present invention also provide for safe installation and operation procedures as well as for the reuse of certain of the perforating string components. Broadly stated, the present invention is directed to a downhole tool for use within a wellbore that includes a housing having a combustion chamber positioned therein, a combustible element positioned in the combustion chambers and an actuatable member. The actuatable member is actuated from a first operating configuration to a second operating configuration responsive to combustion of the combustible element.

In one aspect, the present invention is directed to a method for actuating a downhole tool. The method includes the steps of disposing a combustible element within a combustion chamber of the downhole tool, positioning the downhole tool within a wellbore and combusting the combustible element to actuate the downhole tool from a first operating configuration to a second operating configuration.

More specifically, the present invention is directed to a surge chamber assembly for use within a tool string in a wellbore. The surge chamber assembly includes a housing having one or more openings, a surge chamber and a combustion chamber. The openings provide fluid communication between the exterior of the housing and the surge chamber. A sleeve is slidably positioned within the housing in either a first position wherein fluid communication through the openings is prevented or a second position wherein fluid communication through the openings is allowed. A combustible element is positioned in the combustion chamber such that combusting the combustible element generates pressure that actuates the sleeve from the first position to the second position allowing fluids to enter the surge chamber from the wellbore, thereby creating a dynamic underbalanced pressure condition in the wellbore.

In one embodiment, the combustible element further comprises a propellant, a solid fuel, a rocket fuel, potassium chlorate, potassium perchlorate, nitrocellulose plasticized fuels or the like. The surge chamber assembly may further include a flange positioned within the housing between the surge chamber and the combustion chamber. In this embodiment, the flange may include one or more passageways the provide fluid communication between the combustion chamber and the sleeve. A shear pin may extend between the sleeve and the flange in order to selectively prevent the sleeve from being actuated from the first position to the second position until a predetermined force is applied to the sleeve by the pressure in the combustion chamber. A biasing member may be operably associated with the sleeve to prevent axial movement of the sleeve once the sleeve has been actuated to the second position. A detonating cord may be disposed within the housing and operably positioned relative to the combustible element such that a detonation of the detonating cord ignites the combustible element.

In another aspect, the present invention is directed to a surge chamber assembly for use in a wellbore that includes a housing having first and second sets of openings, a surge chamber and a pair of combustion chambers oppositely disposed relative to the surge chamber. The openings provide fluid communication between the exterior of the housing and the surge chamber. First and second sleeves are slidably positioned within the housing relative to the first and second sets of openings, respectively. Each sleeve has a first position wherein fluid communication through the relative openings is prevented and a second position wherein fluid communication through the relative openings is allowed. A combustible element is positioned in each of the combustion chambers such that combusting each of the combustible elements actuates one of the sleeves from its first position to its second position.

In a further aspect, the present invention is directed to a tool string for use in a wellbore. The tool string includes first and second surge chamber assemblies and at least one perforating gun positioned between the first and second surge chamber assemblies. Each of the first and second surge chamber assemblies includes a housing having one or more openings, a surge chamber and a combustion chamber. The openings provide fluid communication between the exterior of the housing and the surge chamber. A sleeve is slidably positioned within the housing and has a first position wherein fluid communication through the openings is prevented and a second position wherein fluid communication through the openings is allowed. A combustible element is positioned in the combustion chamber such that combusting the combustible element actuates the sleeve from the first position to the second position.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
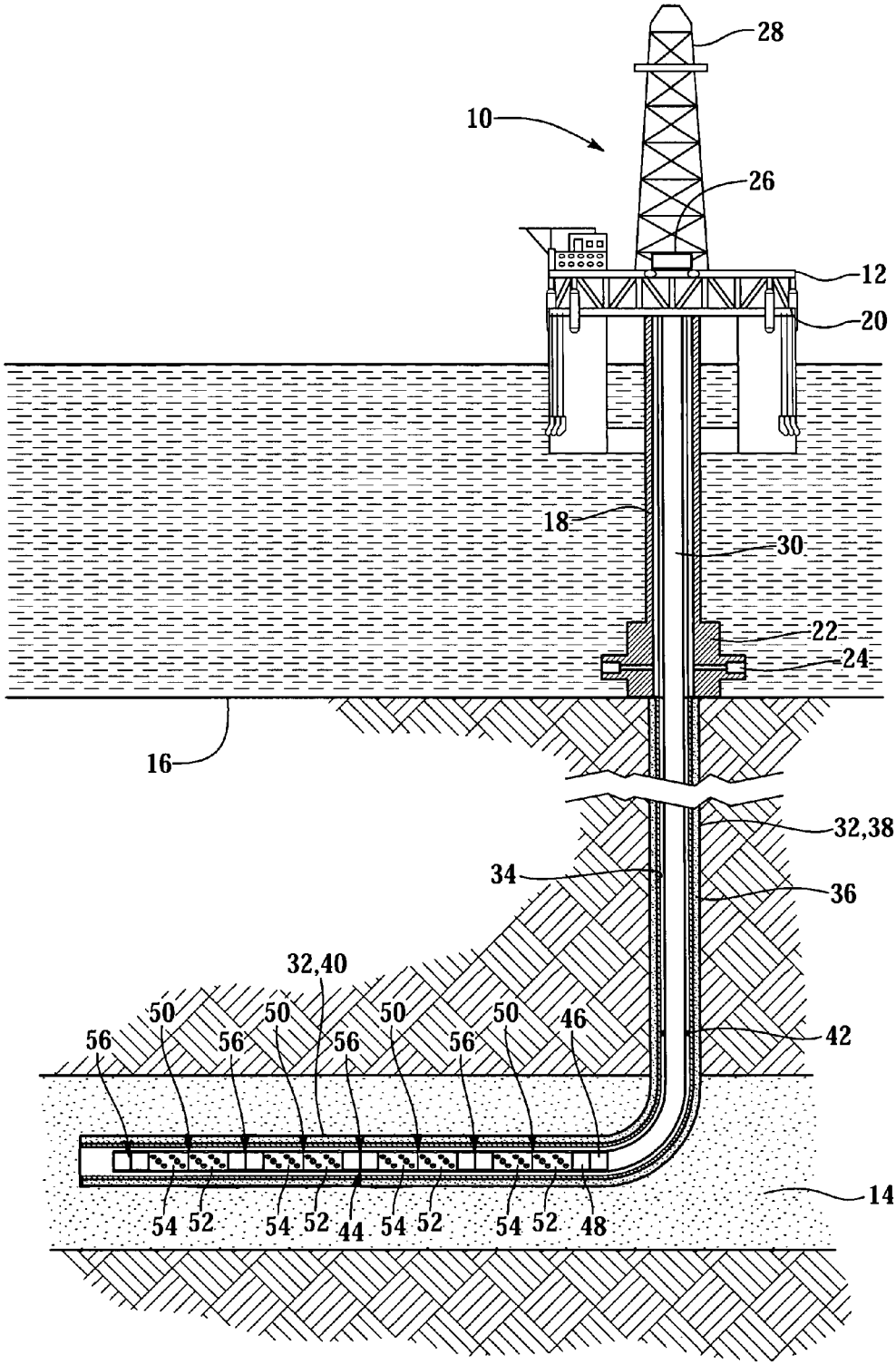
FIG. 1 is a schematic illustration of an offshore oil and gas platform operating a plurality of surge chamber assemblies of the present invention positioned within a tool string including a plurality of perforating guns.

Referring initially to FIG. 1, a plurality of surge chamber assemblies of the present invention operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of perforating guns and a plurality of surge chamber assemblies. When it is desired to perforate formation 14, work string 30 is lowered through casing 34 until the perforating guns are properly positioned relative to formation 14. Thereafter, the shaped charges within the string of perforating guns are sequentially fired, either in an uphole to downhole or a downhole to uphole direction. Upon detonation, the liners of the shaped charges form jets that create a spaced series of perforations extending outwardly through casing 34, cement 36 and into formation 14, thereby allow formation communication between formation 14 and wellbore 32.

In the illustrated embodiment, wellbore 32 has an initial, generally vertical portion 38 and a lower, generally deviated portion 40 which is illustrated as being horizontal. It should be noted, however, by those skilled in the art that the shaped charge perforating guns and the surge chamber assemblies of the present invention are equally well-suited for use in other well configurations including, but not limited to, inclined wells, wells with restrictions, non-deviated wells and the like.

Work string 30 includes a retrievable packer 42 which may be sealingly engaged with casing 34 in vertical portion 38 of wellbore 32. At the lower end of work string 30 is a gun string, generally designated 44. In the illustrated embodiment, gun string 44 has at its upper or near end a ported nipple 46 below which is a time domain firer 48. Time domain firer 48 is disposed at the upper end of a tandem gun set 50 including first and second guns 52 and 54. In the illustrated embodiment, a plurality of such gun sets 50, each including a first gun 52 and a second gun 54 are utilized. Each gun set 50 may have at least one orienting fin (not pictured) extending therefrom to insure that the gun set is disposed off-center with regard to casing 34 as described in U.S. Pat. No. 5,603,379 issued to Halliburton Company on Feb. 18, 1997, which is hereby incorporated by reference. While tandem gun sets 50 have been described, it should be understood by those skilled in the art that any arrangement of guns may be utilized in conjunction with the surge chamber assemblies of the present invention.

Specifically, between each gun set 50 is a surge chamber assembly 56 which serves as a connector for connecting adjacent gun sets 50 together. Further, surge chamber assemblies 56 may serve in the function of a spacer which separates adjacent gun sets 50. As will be discussed in detail below, surge chamber assemblies 56 each include a housing having openings that allows for fluid communication from the wellbore 32 to a surge chamber positioned within the housing. A sleeve is slidably positioned within the housing to selectively permit and prevent fluid communication through the openings. A combustion chamber is positioned in fluid communication with the sleeve. A combustible element is positioned in the combustion chamber such that, upon ignition, the combustible element produces a combustion event that creates pressure within the combustion chamber that actuates the sleeve to enable fluid communication from the wellbore 32 into the surge chamber.

The surge chambers of the surge chamber assemblies 56 are preferably at atmospheric pressure during installation into wellbore 32 and prior to actuation of the sleeves. Accordingly, upon actuation of the sleeves, a fluid surge from wellbore 32 into the surge chambers is generated which creates a dynamic underbalanced condition within wellbore 32. This dynamic underbalanced condition improves the quality of the perforations generated by gun sets 50 as formation fluids will enter wellbore 32 and the surge chambers immediately after the perforations are created. This surge of fluid cleans the perforation tunnels of any debris created during the perforation process and helps to prevent the perforation tunnels from having a low permeability. Importantly, the present invention allows for the sequential firing of the perforating guns 50 and the operating of surge chamber assemblies 56 using timers or other control circuits such that segments of the production interval or intervals may be perforated and allowed to flow then after a time delay, other segments of the production interval or intervals may be perforated and allowed to flow.

Figure 2:
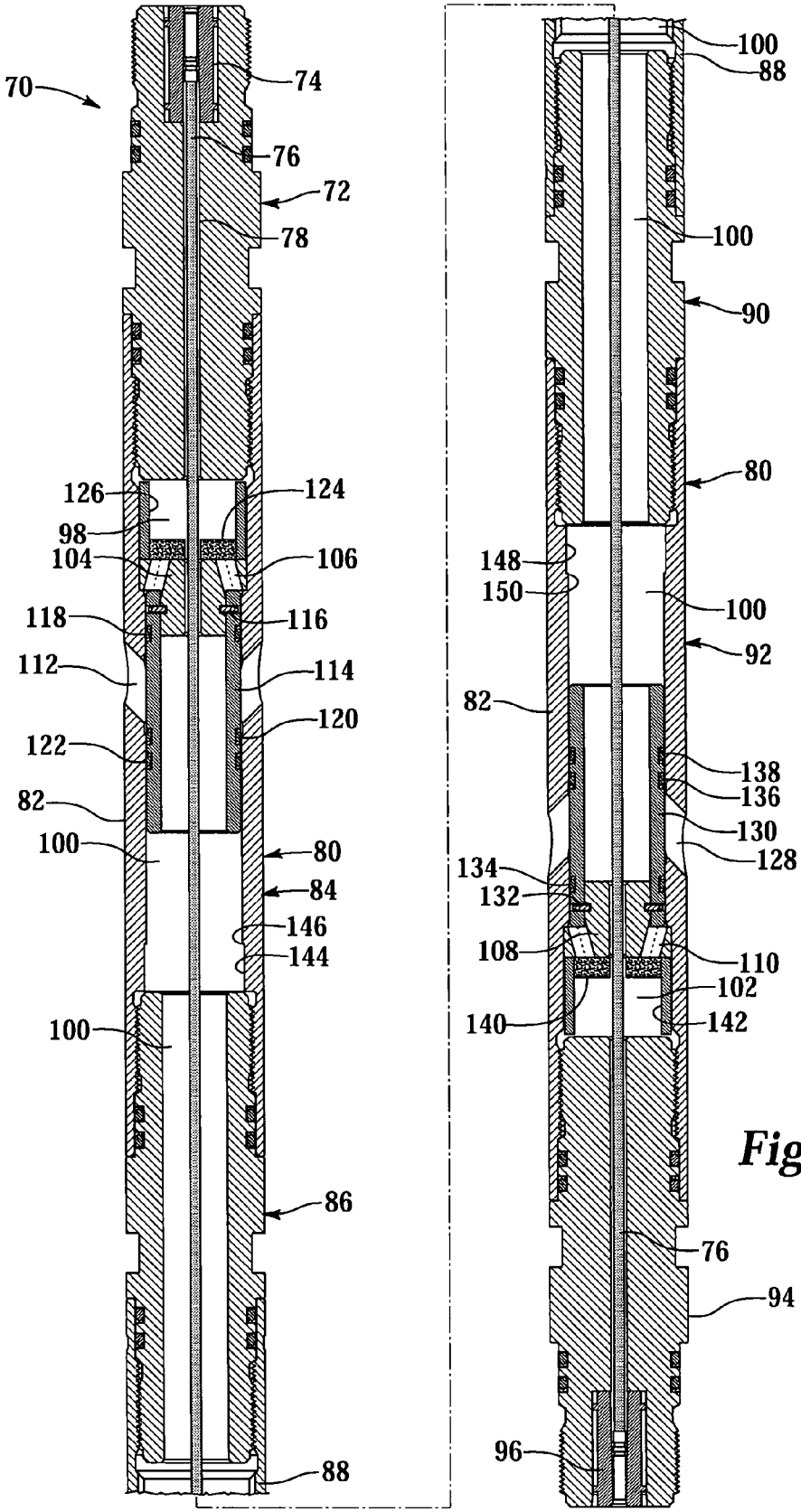
FIG. 2 is a half sectional view of a surge chamber assembly of the present invention depicted in axially successive sections.

FIG. 2 depicts a surge chamber assembly 70 according to the present invention that is generally designated 70. Surge chamber assembly 70 includes an upper tandem 72 that may be connected to a perforating gun as part of a gun string. Positioned within upper tandem 72 is a support member 74 that receives a booster positioned at the upper end of a detonating cord 76. Detonating cord 76 is positioned within a detonation passageway 78 that traverses the length of surge chamber assembly 70. As depicted, a housing 80 having an exterior 82 is threadably and sealingly coupled to upper tandem 72.

Housing 80 includes upper housing section 84, connector 86, intermediate housing section 88, connector 90 and lower housing section 92, each of which are threadably and sealingly coupled to the adjacent housing section. Lower housing section 92 is threadably and sealingly coupled to lower tandem 94. A support member 96 is positioned within lower tandem 94 that receives the booster positioned at the lower end of detonating cord 76. Lower tandem 94 may be connected to a perforating gun at its lower end. As such, a detonation of the detonating cord in a perforating gun above surge chamber assembly 70 will be propagated through surge chamber assembly 70 to a perforating gun below surge chamber assembly 70 via detonating cord 76.

It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

In a downhole operational embodiment, exterior 82 includes the wellbore, perforations and portions of the formation that are proximate housing 80. The interior of housing 80 includes a combustion chamber 98, a surge chamber 100 and a combustion chamber 102. A flange 104 is positioned between combustion chamber 98 and surge chamber 100. Flange 104 includes a plurality of passageways 106, only two of which are depicted. A flange 108 is positioned between combustion chamber 102 and surge chamber 100. Flange 108 includes a plurality of passageways 110, only two of which are depicted. Detonating cord 76 passes through an opening in the center flanges 104, 108.

Upper housing section 84 includes a plurality of openings 112, only two of which are visible in FIG. 2. Openings 112 allow for fluid communication between exterior 82 and surge chamber 100. A sliding sleeve 114 is fitted within upper housing section 84 to selectively allow and prevent fluid communication through openings 112. In the illustrated closed position of surge chamber assembly 70, shear pins 116 secure sliding sleeve 114 to flange 104. It should be appreciated by those skilled in the art that although only two shear pins 116 are illustrated and described, any number of shear pins may be utilized in accordance with the force desired to shift sliding sleeve 114. In the closed position, a pair of seals 118, 120 prevent fluid communications through openings 112. In addition, a biasing member such as snap ring 122 is positioned exteriorly of sleeve 114. Passageways 106 through flange 104 provide for fluid communication between combustion chamber 98 and sliding sleeve 114.

A combustible element which is illustrated as a propellant 124 is positioned within combustion chamber 98 and secured in place with a propellant sleeve 126. Preferably, propellant 124 is a substance or mixture that has the capacity for extremely rapid but controlled combustion that produces a combustion event including the production of a large volume of gas at high temperature and pressure. Propellant 124 is preferably a solid but may be a liquid or combination thereof. In an exemplary embodiment, propellant 124 comprises a solid propellant such as nitrocellulose plasticized with nitroglycerin or various phthalates and inorganic salts suspended in a plastic or synthetic rubber and containing a finely divided metal. Moreover, in this exemplary embodiment, propellant 124 may comprise inorganic oxidizers such as ammonium and potassium nitrates and perchlorates. Most preferably, potassium perchlorate is employed. It should be appreciated, however, that substances other than propellants may be utilized. For example, explosives such as black powder or powder charges may be utilized.

Lower housing section 92 includes a plurality of openings 128, only two of which are visible in FIG. 2. Openings 128 allow for fluid communication between exterior 82 and surge chamber 100. A sliding sleeve 130 is fitted within lower housing section 92 to selectively allow and prevent fluid communication through openings 128. In the illustrated closed position of surge chamber assembly 70, shear pins 132 secure sliding sleeve 130 to flange 108. In the closed position, a pair of seals 134, 136 prevent fluid communications through openings 128. In addition, a biasing member such as a snap ring 138 is positioned exteriorly of sleeve 130. Passageways 110 through flange 108 provide for fluid communication between combustion chamber 102 and sliding sleeve 130. A combustible element which is illustrated as a propellant 140 is positioned within combustion chamber 102 and secured in place with a propellant sleeve 142.

Figure 3:
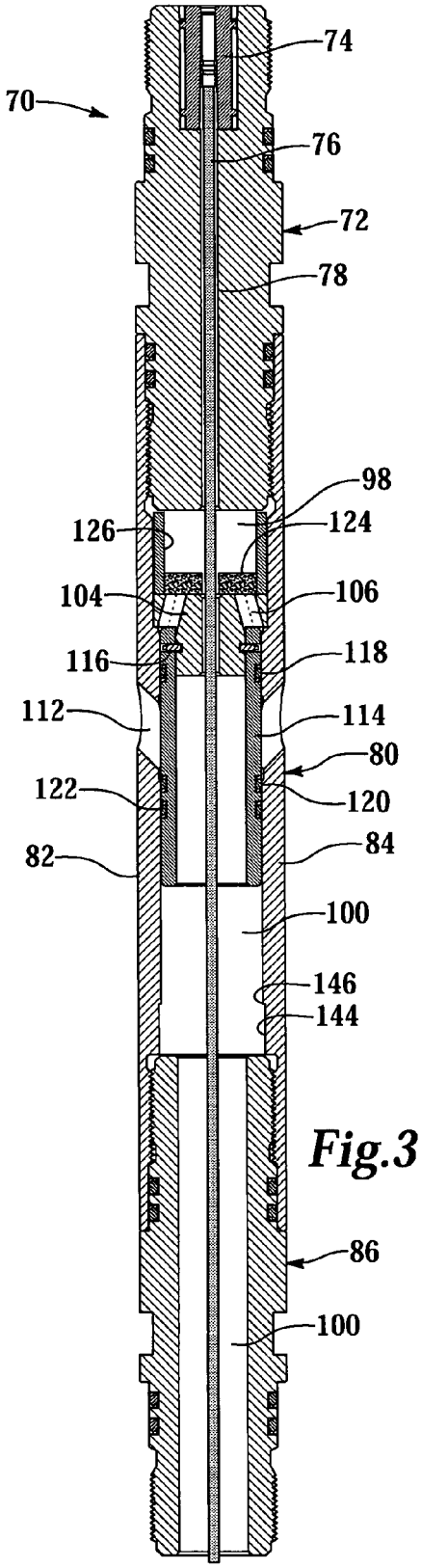
FIG. 3 is a half sectional view of an upper section of a surge chamber assembly of the present invention in a closed position.
Figure 4:
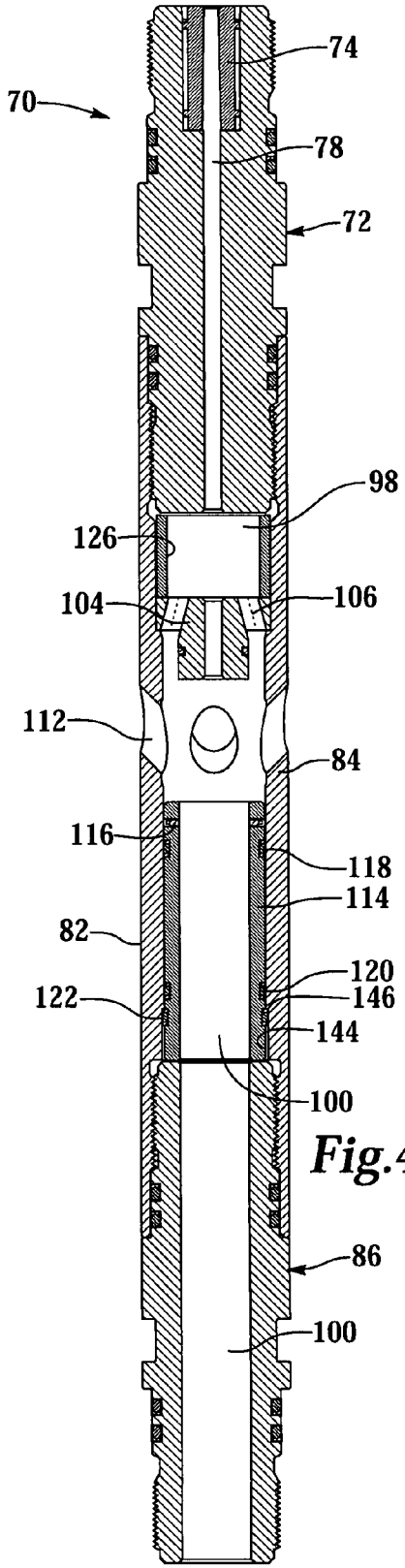
FIG. 4 is a half sectional view of an upper section of the surge chamber assembly of the present invention in an open position.

The operation of the surge chamber assembly 70 of the present invention will now be described with reference to FIGS. 3 and 4 which depict an upper portion of surge chamber assembly 70. When it is desirable to operate surge chamber assembly 70, an explosion in the form of a detonation is propagated through surge chamber assembly 70 via detonating cord 76. As one skilled in the art will appreciate, the explosion of detonation cord 76 is an extremely rapid, self-propagating decomposition of detonating cord 76 that creates a high-pressure-temperature wave that moves rapidly through surge chamber assembly 70. The explosion of detonating cord 76 ignites propellant 124 and causes a combustion once propellant 124 reaches its autoignition point, i.e., the minimum temperature required to initiate or cause self-sustained combustion.

When the explosion of detonation cord 76 is within combustive proximity of propellant 124, propellant 124 ignites. The combustion of propellant 124 produces a large volume of gas which pressurizes combustion chamber 98. As one skilled in the art will also appreciate, the combustion of propellant 124 is an exothermic oxidation reaction that yields large volumes of gaseous end products of oxides at high pressure and temperature. In particular, the volume of oxides created by the combustion of propellant 124 within combustion chamber 98 provides the force required to actuate sliding sleeve 114. More specifically, the pressure within combustion chamber 98 acts on sliding sleeve 114 until the force generated is sufficient to break shear pins 116. Once shear pins 116 are broken, sliding sleeve 114 is actuated to an open position such that openings 112 are not obstructed and fluid communication from exterior 82 to surge chamber 100 is allowed, as best seen in FIG. 4. The lower portion of upper housing section 84 includes a radially expanded region 144 that defines a shoulder 146. As sliding sleeve 114 slides into contact with the upper end of connector 86, snap ring 122 expands to prevent further axial movement of sleeve 114.

Likewise, as best seen in FIG. 2, when the explosion of detonation cord 76 is within combustive proximity of propellant 140, propellant 140 ignites. The combustion of propellant 140 produces a large volume of gas which pressurizes combustion chamber 102. The pressure within combustion chamber 102 acts on sliding sleeve 130 until the force generated is sufficient to break shear pins 132. Once shear pins 132 are broken, sliding sleeve 130 is actuated to an open position such that openings 128 are not obstructed and fluid communication from exterior 82 to surge chamber 100 is allowed. In the illustrated embodiment, the lower portion of upper housing section 92 includes a radially expanded region 148 that defines a shoulder 150. As sliding sleeve 130 slides into contact with the lower end of connector 90, snap ring 138 expands to prevent further axial movement of sleeve 130.

Prior to detonation of detonating cord 76, the wellbore in which the gun string and one or more surge chamber assemblies 70 is positioned may preferably be in an overbalanced condition. During operation, a series of perforating guns and surge chamber assemblies 70 operate substantially simultaneously. This operation allows fluids from within the wellbore to enter the surge chambers which dynamically creates an underbalanced pressure condition. This permits the perforation discharge debris to be cleaned out of the perforation tunnels due to the fluid surge from the formation into the surge chambers. The cleansing inflow continues until a stasis is reached between the pressure in the formation and the pressure within the casing. Hence, surge chamber assembly 70 of the present invention ensures clean perforation tunnels by providing a dynamic underbalanced condition. Addition series of perforating guns and surge chamber assemblies 70 may thereafter be operated which will again dynamically create an underbalanced pressure condition for the newly shot perforations.

Figure 5:
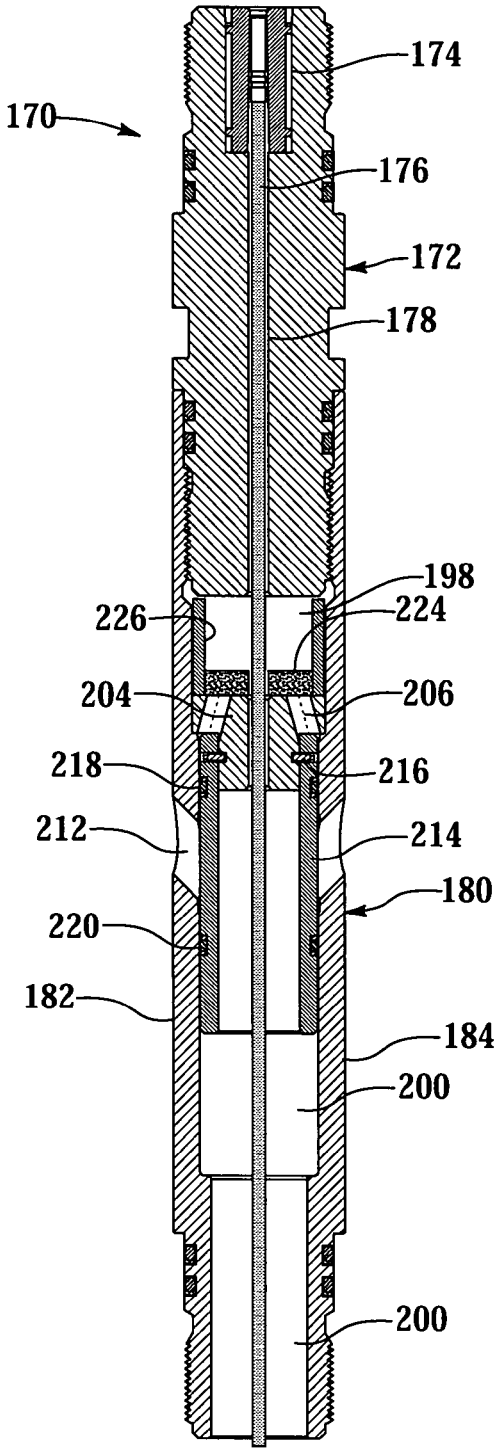
FIG. 5 is a half sectional view of an alternate embodiment of an upper section of a surge chamber assembly of the present invention in a closed position.

Referring now to FIG. 5, therein is illustrated an alternate embodiment of an upper portion of a surge chamber assembly of the present invention in a closed position that is generally designated 170. Surge chamber assembly 170 includes an upper tandem 172 that may be connected to a perforating gun as part of a gun string. Positioned within upper tandem 172 is a support member 174 that receives a booster positioned at the upper end of a detonating cord 176. Detonating cord 176 is positioned within a detonation passageway 178 that traverses the length of surge chamber assembly 170 in the manner described above with reference to surge chamber assembly 70 of FIG. 2. As depicted, a housing 180 having an exterior 182 is threadably and sealingly coupled to upper tandem 172.

Housing 180 includes upper housing section 184 as well as additional housing sections (not pictured) such as those described above with reference to surge chamber assembly 70 of FIG. 2. In a downhole operational embodiment, exterior 182 includes the wellbore, perforations and portions of the formation that are proximate housing 180. In the illustrated upper portion of surge chamber assembly 170, the interior of housing 180 includes a combustion chamber 198 and surge chamber 200. A flange 204 is positioned between combustion chamber 198 and surge chamber 200. Flange 204 includes a plurality of passageways 206, only two of which are depicted. Detonating cord 176 passes through an opening through the center flange 204.

Upper housing section 184 includes a plurality of openings 212, only two of which are visible in FIG. 5. Openings 212 allow for fluid communication between exterior 182 and surge chamber 200. A sliding sleeve 214 is fitted within upper housing section 184 to selectively allow and prevent fluid communication through openings 212. In the illustrated closed position of surge chamber assembly 170, shear pins 216 secure sliding sleeve 214 to flange 204. In the closed position, a pair of seals 218, 220 prevent fluid communications through openings 212. Unlike surge chamber assembly 70 of FIG. 2, however, sleeve 214 does not carry a snap ring exteriorly thereof and upper housing section 184 does not include a radially expanded portion.

A combustible element which is illustrated as a propellant 224 is positioned within combustion chamber 198 and secured in place with a propellant sleeve 226. The operation of surge chamber assembly 170 is substantially identical to the operation of surge chamber assembly 70 of FIG. 2 except that sleeve 214 will not be secured to upper housing section 184 after actuation.

Figure 6:
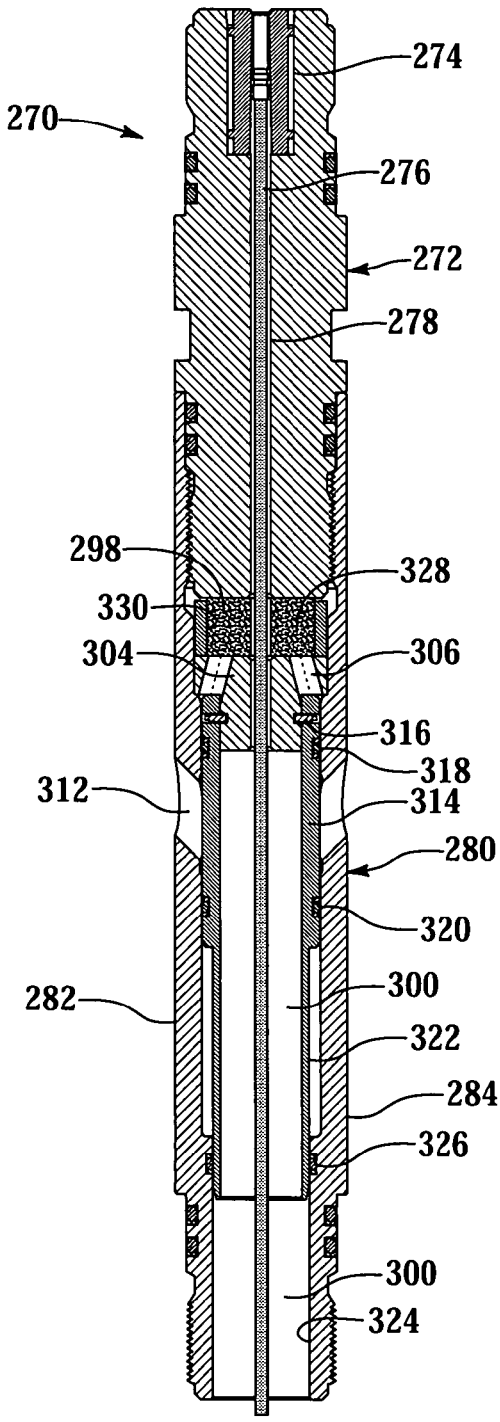
FIG. 6 is a half sectional view of a further embodiment of an upper section of a surge chamber assembly of the present invention in a closed position.

Referring now to FIG. 6, therein is illustrated an further alternate embodiment of an upper portion of a surge chamber assembly of the present invention in a closed position that is generally designated 270. Surge chamber assembly 270 includes an upper tandem 272 that may be connected to a perforating gun as part of a gun string. Positioned within upper tandem 272 is a support member 274 that receives a booster positioned at the upper end of a detonating cord 276. Detonating cord 276 is positioned within a detonation passageway 278 that traverses the length of surge chamber assembly 270 in the manner described above with reference to surge chamber assembly 70 of FIG. 2. As depicted, a housing 280 having an exterior 282 is threadably and sealingly coupled to upper tandem 272.

Housing 280 includes upper housing section 284 as well as additional housing sections (not pictured) such as those described above with reference to surge chamber assembly 70 of FIG. 2. In a downhole operational embodiment, exterior 282 includes the wellbore, perforations and portions of the formation that are proximate housing 280. In the illustrated upper portion of surge chamber assembly 270, the interior of housing 280 includes a combustion chamber 298 and surge chamber 300. A flange 304 is positioned between combustion chamber 298 and surge chamber 300. Flange 304 includes a plurality of passageways 306, only two of which are depicted. Detonating cord 276 passes through an opening through the center flange 304.

Upper housing section 284 includes a plurality of openings 312, only two of which are visible in FIG. 6. Openings 312 allow for fluid communication between exterior 282 and surge chamber 300. A sliding sleeve 314 is fitted within upper housing section 284 to selectively allow and prevent fluid communication through openings 312. In the illustrated closed position of surge chamber assembly 270, shear pins 316 secure sliding sleeve 314 to flange 304. In the closed position, a pair of seals 318, 320 prevent fluid communications through openings 312. Unlike surge chamber assembly 70 of FIG. 2, however, sleeve 314 does not carry a snap ring exteriorly thereof and upper housing section 284 does not include a radially expanded portion. Instead, sleeve 314 includes a sleeve extension 322 that slides within a radially reduced portion 324 of upper housing section 284. Radially reduced portion 324 includes a seal 326.

A combustible element which is illustrated as a propellant 328 is positioned within combustion chamber 298 and secured in place with a propellant sleeve 330. The operation of surge chamber assembly 270 is substantially identical to the operation of surge chamber assembly 70 of FIG. 2 except that sleeve 314 will not be secured to upper housing section 284 after actuation.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A surge chamber assembly for use in a wellbore, the surge chamber assembly comprising:

a housing having an opening, a surge chamber and a combustion chamber, the opening providing fluid communication between the exterior of the housing and the surge chamber;

a sleeve slidably positioned within the housing having a first position wherein fluid communication through the opening is prevented and a second position wherein fluid communication through the opening is allowed; and a combustible element positioned in the combustion chamber such that combusting the combustible element actuates the sleeve from the first position to the second position.

2. The surge chamber assembly as recited in claim 1 wherein the combustible element further comprises a propellant.

3. The surge chamber assembly as recited in claim 1 wherein the combustible element further comprises a solid fuel.

4. The surge chamber assembly as recited in claim 1 wherein the combustible element further comprises a rocket fuel.

5. The surge chamber assembly as recited in claim 1 wherein the combustible element further comprises a mixture selected from the group consisting of potassium chlorate, potassium perchlorate and nitrocellulose plasticized fuels.

6. The surge chamber assembly as recited in claim 1 further comprising a flange positioned within the housing between the surge chamber and the combustion chamber.

7. The surge chamber assembly as recited in claim 6 wherein the flange includes a passageway that provides fluid communication between the combustion chamber and the sleeve.

8. The surge chamber assembly as recited in claim 6 further comprising a shear pin extending between the sleeve and the flange that selectively prevents the sleeve from being actuated from the first position to the second position until a predetermined force is applied to the sleeve by the combustion event.

9. The surge chamber assembly as recited in claim 1 further comprising a biasing member operably associated with the sleeve to prevent axial movement of the sleeve once the sleeve has been actuated from the first position to the second position by the combustion event.

10. The surge chamber assembly as recited in claim 1 wherein upon actuation of the sleeve from the first position to the second position, fluids from exterior of the housing enter the surge chamber.

11. A downhole tool for use within a wellbore, the downhole tool comprising:

a housing having a combustion chamber and a surge chamber positioned therein;

a combustible element positioned in the combustion chambers; and an actuatable member having first and second operating configurations, wherein the actuatable member is actuated from the first operating configuration to the second operating configuration responsive to combustion of the combustible element.

12. The downhole tool as recited in claim 11 wherein the combustible element is selected from a group consisting propellants, solid fuels, rocket fuels, potassium chlorate, potassium perchlorate and nitrocellulose plasticized fuels.

13. The downhole tool as recited in claim 11 wherein the actuatable member further comprises a sliding sleeve.

14. A method for actuating a downhole tool comprising the steps of:

disposing a combustible element within a combustion chamber of the downhole tool, the downhole tool including a surge chamber;

positioning the downhole tool within a wellbore; and combusting the combustible element to actuate the downhole tool from a first operating configuration to a second operating configuration.

15. The method as recited in claim 14 wherein the step of disposing a combustible element within a combustion chamber of the downhole tool further comprises selecting the combustible element from a group consisting propellants, solid fuels, rocket fuels, potassium chlorate, potassium perchlorate and nitrocellulose plasticized fuels.

16. The method as recited in claim 14 wherein the step of combusting the combustible element to actuate the downhole tool from a first operating configuration to a second operating configuration further comprises actuating a sliding sleeve from a first position to a second position.

17. The method as recited in claim 14 further comprising the step of establishing an underbalanced pressure condition within the wellbore.

* * * * *